US011413900B2

(12) United States Patent
Kavanagh

(10) Patent No.: US 11,413,900 B2
(45) Date of Patent: Aug. 16, 2022

(54) SECURITY FEATURE AND METHOD OF MANUFACTURE THEREOF

(71) Applicant: CCL Secure Pty Ltd, Craigieburn (AU)

(72) Inventor: Michael Kavanagh, Craigieburn (AU)

(73) Assignee: CCL SECURE PTY LTD, Craigieburn (AU)

( * ) Notice: Subject to any disclaimer, the term of this patent is extended or adjusted under 35 U.S.C. 154(b) by 0 days.

(21) Appl. No.: 17/326,768

(22) Filed: May 21, 2021

(65) Prior Publication Data

US 2021/0276358 A1 Sep. 9, 2021

Related U.S. Application Data

(63) Continuation of application No. PCT/AU2019/051297, filed on Nov. 26, 2019.

(30) Foreign Application Priority Data

Nov. 26, 2018 (AU) ..... 2018101824

(51) Int. Cl.

| | |
|---|---|
| ***B42D 25/351*** | (2014.01) |
| ***B42D 25/29*** | (2014.01) |
| ***B42D 25/45*** | (2014.01) |
| ***B42D 25/36*** | (2014.01) |
| ***B41M 3/14*** | (2006.01) |
| ***B42D 25/23*** | (2014.01) |
| ***B42D 25/24*** | (2014.01) |

(52) U.S. Cl.
CPC ..... *B42D 25/351* (2014.10); *B42D 25/29* (2014.10); *B42D 25/45* (2014.10)

(58) Field of Classification Search
CPC ..... B42D 25/351; B42D 25/29; B42D 25/45; B42D 25/23; B41M 3/14
USPC ..... 283/72, 74, 94, 98, 901
See application file for complete search history.

(56) References Cited

FOREIGN PATENT DOCUMENTS

| | | | | |
|---|---|---|---|---|
| WO | WO 2011/135344 A1 | 11/2011 | | |
| WO | WO 2017/055823 A1 | 4/2017 | | |
| WO | WO-2017055823 A1 * | 4/2017 | ..... | B42D 25/373 |
| WO | WO 2018/178662 A1 | 10/2018 | | |

OTHER PUBLICATIONS

PCT International Search Report and Written Opinion, PCT Application No. PCT/AU2019/051297, dated Jan. 29, 2020 eight pages.

* cited by examiner

*Primary Examiner* — Justin V Lewis
(74) *Attorney, Agent, or Firm* — Fenwick & West LLP

(57) ABSTRACT

The present disclosure relates to methods of producing substrate level multi-tonal images.

20 Claims, 5 Drawing Sheets

SECURITY FEATURE AND METHOD OF MANUFACTURE THEREOF

CROSS-REFERENCE TO RELATED APPLICATIONS

This application is a bypass continuation of PCT International Patent Application No. PCT/AU2019/051297, filed on Nov. 26, 2019, which claims priority to Australian Patent Application No. 2018101824, filed on Nov. 26, 2018, which are incorporated by reference herein in their entirety.

FIELD OF THE INVENTION

The invention relates generally to the field of security features and security documents suitable for use in making banknotes, identity documents, passports, certificates and the like, as well as methods for producing such security features and security documents.

BACKGROUND TO THE INVENTION

It is well known to include security features within documents requiring a level of security, for example banknotes. Such security features can take on a number of forms. However, particularly useful features are ones that are visually apparent and therefore inspectable with relative ease.

However, over recent years, counterfeiting groups have become better organised and more technically competent, and the high returns from counterfeiting, in spite of the risks, have become more readily appreciated by unscrupulous groups. The attempts at simulation of genuine security devices have become more and more successful. This problem is exacerbated by the fact that the authentication process for the banknote by members of the public has long been recognised as the weakest point in the security systems. Often, such security features require inspection by members of the public to be useful, but may be overly complicated to correctly view or may not provide a strong effect that is easily recognised. This diminishes the usefulness of such features in allowing the public to take an active role in reducing the cost of counterfeiting.

Therefore, it is desirable to provide security features which are difficult to reproduce and therefore, counterfeit, while engaging the public such that regular authentication of banknotes can take place.

It is an object of the present invention to provide a security feature and/or a security document incorporating a security feature, which addresses one or more limitations of the prior art, or at least provide an alternative choice for the general public.

SUMMARY OF INVENTION

According to a first aspect of the present invention, there is provided a security feature comprising: a substrate including a first surface and a second surface, a first image layer applied to the first surface of the substrate, by depositing a coloured ink in selected regions of the substrate in accordance with a first image, a second image layer applied to the substrate, wherein the second image layer is a layer of semi-opaque material including transparent or translucent regions in which the semi-opaque material is omitted or reduced, at least some of the transparent or translucent regions overlap with the first image, wherein the first and the second image layer collectively define a coloured multi-tonal image that is visible both in transmission and reflection.

Preferably, the coloured ink is deposited on less than 50% surface area of the substrate, or less than 30%, or less than 20%.

The first and the second image layers may be provided on opposing first and second surfaces of the substrate, or on the same surface of the substrate.

Preferably, the transparent or translucent regions of the second image layer are arranged in accordance with one or more tonal values of the multi-tonal image. Preferably, the transparent or translucent regions of the second image layer correspond to darker tone(s) of the multi-tonal image.

Preferably, the first image layer defines a mono-tonal version of the multi-tonal image, and the second image layer provides tonal variations for the mono-tonal image.

Preferably, the first and the second image layers are both printed using a gravure printing unit in an in-line printing process.

Preferably, one or more additional layers of opacifying material are applied to the second surface of the substrate. Preferably, the multi-tonal image is not formed in a window, or a half-window region of the substrate.

Preferably, the multi-tonal image is visible as a coloured mono-tonal image (free of visually perceivable tonal variation) from the second surface of the substrate.

According to a second aspect of the invention, there is provided a security feature comprising a single printed working applied to a substrate, wherein the single printed working displays a multi-tonal image visible both in reflection and transmission, and the multi-tonal image appears substantially similar from either side of the substrate.

Preferably, the single printed working is applied by a gravure printing unit. The tonal variations can be achieved by half toning, and/or modulating one or more ink cells of a gravure cylinder.

Preferably, the multi-tonal image is formed in a window or a half-window region of the substrate.

According to a third aspect of the present invention, there is provided a security feature comprising: a substrate including a first surface and a second surface, a first and a second printed working applied to the substrate, wherein the first and the second printed working at least partially overlap and are registered to one another, the first printed working is multi-tonal and the second printed working is substantially free of tonal variation, the first and the second printed working are each formed in a single printed layer and in contrasting colours, the first and the second printed working collectively provide a coloured multi-tonal image visible both in reflection and transmission.

Preferably, the first and the second printed working are applied to opposing surfaces of the substrate.

Preferably, the multi-tonal image is visible from either side of the substrate.

Preferably, the multi-tonal image appears substantially similar in reflection and transmission.

Preferably, the first printed working is formed in a substantially white or grey colour, and the second printed working is formed in a different colour which visually contrasts with white or grey, for example, blue.

Preferably, the first and the second printed working are both formed using a gravure printing unit in an in-line process, said gravure printing unit includes a gravure cylinder having an printing surface. In one form, the printing surface of the gravure cylinder includes an array of ink cells configured to receive ink during an image printing process, wherein the ink cells are modulated in accordance with tonal variation that is required to produce the multi-tonal effect.

Preferably, the first printed working is a halftone image in which tonal variation is produced by variously sized dots of ink.

Preferably, the security feature is formed in a window or a half-window region of a security substrate, said security substrate can be printed upon and further processed into a security document.

Preferably, the substrate of the first, second, and third aspect is substantially transparent and is made from a polymeric material.

It will be appreciated that the substrate may be surface treated, or may include one or more additional printed layers before or after the one or more security features are applied, such as a primer layer and/or additional coloured or non-coloured layers.

In a fourth aspect, the invention includes a security document including one or more security features of the first, second, or third aspects.

In one form, the security document includes one or more overlapping opacifying layers disposed on the first and/or second surfaces of the substrate, at least some of the opacifying layers are semi-opaque.

The present invention also provides a method of making a security document incorporating one or more security features of the first, second, or third aspects.

It will be appreciated that the multi-tonal image of the first aspect is achieved by cumulative effect of two overlapping image layers, wherein neither of the image layers includes multi-tonal information. The first image layer provides a mono-tonal version of the final multi-tonal image, and the second image layer creates the tonal variations for the mono-tonal image. In contrast, the multi-tonal images of the second and the third aspects are achieved by providing tonal variation in a single printed layer, whether in or outside of the window area, making the multi-tonal image visible both in transmission and reflection.

Security Document or Token

As used herein the term security documents and tokens includes all types of documents and tokens of value and identification documents including, but not limited to the following: items of currency such as banknotes and coins, credit cards, cheques, passports, identity cards, securities and share certificates, driver's licenses, deeds of title, travel documents such as airline and train tickets, entrance cards and tickets, birth, death and marriage certificates, and academic transcripts.

The invention is particularly, but not exclusively, applicable to security documents or tokens such as banknotes or identification documents such as identity cards or passports formed from a substrate to which one or more layers of printing are applied. The diffraction gratings and optically variable devices described herein may also have application in other products, such as packaging.

Security Device or Feature

As used herein the term security device or feature includes any one of a large number of security devices, elements or features intended to protect the security document or token from counterfeiting, copying, alteration or tampering. Security devices or features may be provided in or on the substrate of the security document or in or on one or more layers applied to the base substrate, and may take a wide variety of forms, such as security threads embedded in layers of the security document; security inks such as fluorescent, luminescent and phosphorescent inks, metallic inks, iridescent inks, photochromic, thermochromic, hydrochromic or piezochromic inks; printed and embossed features, including relief structures; interference layers; liquid crystal devices; lenses and lenticular structures; optically variable devices (OVDs) such as diffractive devices including diffraction gratings, holograms and diffractive optical elements (DOEs).

Substrate

As used herein, the term substrate refers to the base material from which the security document or token is formed. The base material may be paper or other fibrous material such as cellulose; a plastic or polymeric material including but not limited to polypropylene (PP), polyethylene (PE), polycarbonate (PC), polyvinyl chloride (PVC), polyethylene terephthalate (PET); or a composite material of two or more materials, such as a laminate of paper and at least one plastic material, or of two or more polymeric materials.

Windows and Half Windows

As used herein the term window refers to a transparent or translucent area in the security document compared to the substantially opaque region to which printing is applied. The window may be fully transparent so that it allows the transmission of light substantially unaffected, or it may be partly transparent or translucent partially allowing the transmission of light but without allowing objects to be seen clearly through the window area.

A window area may be formed in a polymeric security document which has at least one layer of transparent polymeric material and one or more opacifying layers applied to at least one side of a transparent polymeric substrate, by omitting least one opacifying layer in the region forming the window area. If opacifying layers are applied to both sides of a transparent substrate, a fully transparent window may be formed by omitting the opacifying layers on both sides of the transparent substrate in the window area.

A partly transparent or translucent area, hereinafter referred to as a "half-window", may be formed in a polymeric security document which has opacifying layers on both sides by omitting the opacifying layers on one side only of the security document in the window area so that the "half-window" is not fully transparent, but allows some light to pass through without allowing objects to be viewed clearly through the half-window.

Alternatively, it is possible for the substrates to be formed from an substantially opaque material, such as paper or fibrous material, with an insert of transparent plastics material inserted into a cut-out, or recess in the paper or fibrous substrate to form a transparent window or a translucent half-window area.

Opacifying Layers

One or more opacifying layers may be applied to a transparent substrate to increase the opacity of the security document. An opacifying layer is such that $L_T$<Lo, where Lo is the amount of light incident on the document, and Li is the amount of light transmitted through the document. An opacifying layer may comprise any one or more of a variety of opacifying coatings. For example, the opacifying coatings may comprise a pigment, such as titanium dioxide, dispersed within a binder or carrier of heat-activated cross-linkable polymeric material. Alternatively, a substrate of transparent plastic material could be sandwiched between opacifying layers of paper or other partially or substantially opaque material to which indicia may be subsequently printed or otherwise applied.

Further features and advantages of the present invention will become apparent from the following detailed description.

BRIEF DESCRIPTION OF THE DRAWINGS

By way of example only, preferred embodiments of the invention will be described more fully hereinafter with reference to the accompanying figures. It is to be appreciated that the embodiments are given by way of illustration only and the invention is not limited by this illustration. In the drawings.

DETAILED DESCRIPTION OF EMBODIMENTS

For the purposes of the following discussion, the figures are to be considered illustrative and not to scale, unless otherwise indicated. The figures illustrate simplified depictions of the embodiments described.

"Colour" as used herein refers to a colour as perceived, and may correspond to a single range of wavelengths or a mixing of different ranges of wavelengths.

First Embodiment

Figure 1A:
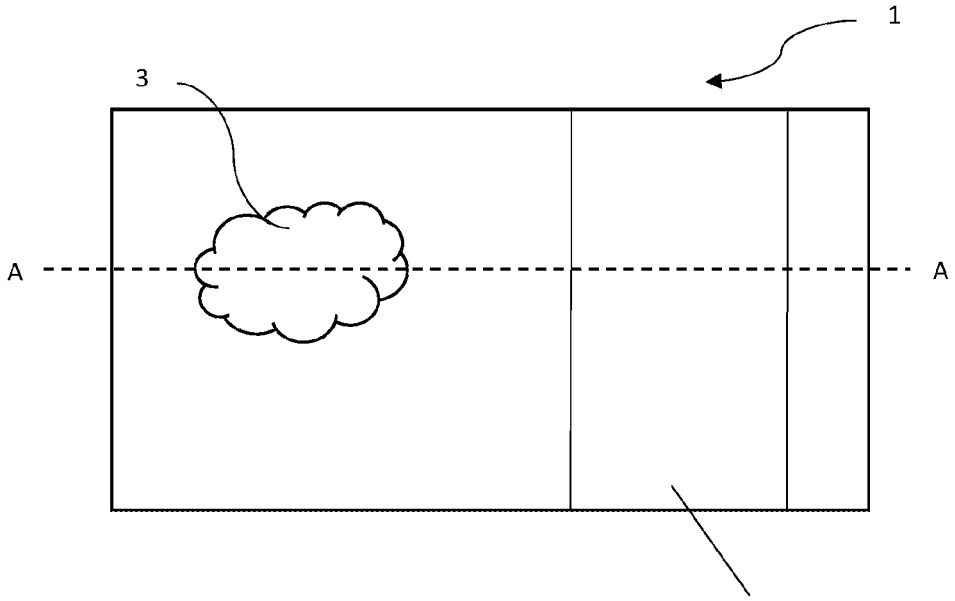
FIG. 1*a* shows a security document including a security feature according to a first embodiment of the invention in a plan view.

Referring to FIG. 1*a*, a security document 1 includes an exemplary first embodiment of the present invention. The security document 1 includes a window region 2, and a security feature provided as a multi-tonal image 3 in a selected region of the document 1. The multi-tonal image 3 is a coloured multi-tonal image, meaning that it has a colour that visually contrasts with the colour of the rest of the security document 1, which, in this example, is generally white or light grey.

Figure 2A:
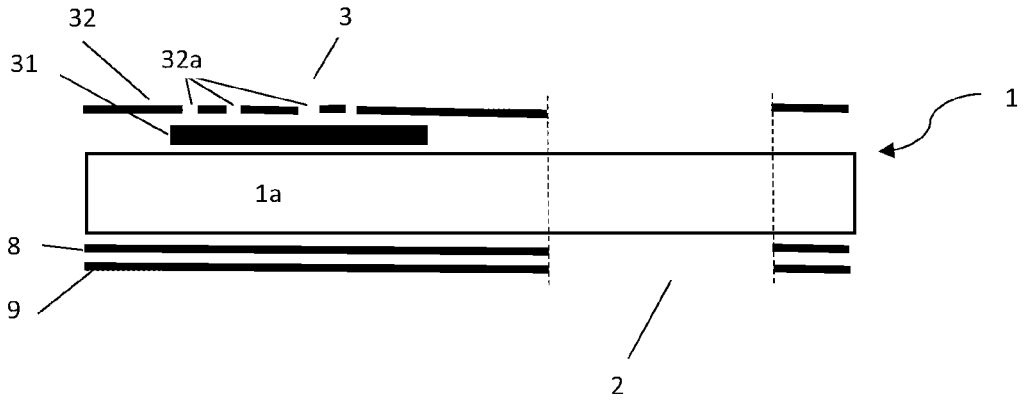
FIG. 2*a* shows a cross-section of FIG. 1*a* along ling A-A.

FIG. 2*a* shows a cross-section of the embodiment of FIG. 1*a* along line A-A. The security document 1 is formed by applying various printed layers on opposing surfaces of a polymer based base substrate 1*a*, which is typically substantially transparent.

The multi-tonal image 3 comprises two image layers 31 and 32. The first image layer 31 is applied as a coloured ink layer over a selected region of the base substrate 1*a*. The coloured ink layer can be either continuous, or discontinuous. It generally forms a mono-tonal, that is having equal tone throughout, version of the final multi-tonal image that is to be observed by a viewer through the use of the presence or absence of the layer. Hence, a mono-tonal version of layer 31 provides for an image layer, being a representation of a particular image (such as a cloud as in FIG. 2*a*) with no variation in the image other than at its outline. The image represented by layer 31 may be such that the outline provides for a discontinuous image layer. The second image layer 32 is then applied over the first image layer 31 to introduce tonal variation by including regions 32*a* in which the material used to form the second image layer 32 is either completely omitted or at least reduced. For example, the second image layer 32 can include one or more gaps, openings, in accordance with a desired tonal value and tonal pattern of image pixels of the multi-tonal image 3. In regions 32*a*, portions of the second image layer 32 are shown through the first image layer 31 directly, whereas in regions outside of 32*a*, a combination colour effect of the first image layer 31 and the second image layer 32 is observed. As such, when viewed from a first side of the security document 1, the multi-tonal image 3 will display a darker tone or a more vibrant colour tone in regions 32*a* and a lighter tone or a pale colour in the rest of the imagery area.

In this embodiment, the first and the second image layers 31 and 32 are applied on the same side of the base substrate 1*a*. In another embodiment, the first and second image layers 31 and 32 may be provided on opposing surfaces of the base substrate 1*a*.

Typically, the first image layer 31 only occupies less than 50% of the surface area of the substrate 1*a*, or less than 30%, or more preferably less than 20%. This is to allow further and additional security features to be applied to the security document 1, thereby enhancing its security.

When viewed from the top side, the multi-tonal effect is clearly visible both in reflection and transmission. When viewed from the bottom side, a mono-tonal version of the image layer 31 is visible, both in reflection and transmission. In addition, the appearances of the multi-tonal effect are substantially similar in reflection and transmission.

In another embodiment, a tonal variation may be directly introduced into the first or the second image layers 31 or 32 by suitable means. This embodiment will create a more complex multi-tonal imagery effect, as an increased number of tonal values, that is more than two tones, can be created across the multi-tonal image 3. In this embodiment, a multi-tonal image is observable from both sides of the security document 1. Details of how a tonal variation can be created in a single imagery layer will be described below and specifically in relation to FIGS. 1*b* and 2*b*.

Second Embodiment

Figure 1B:
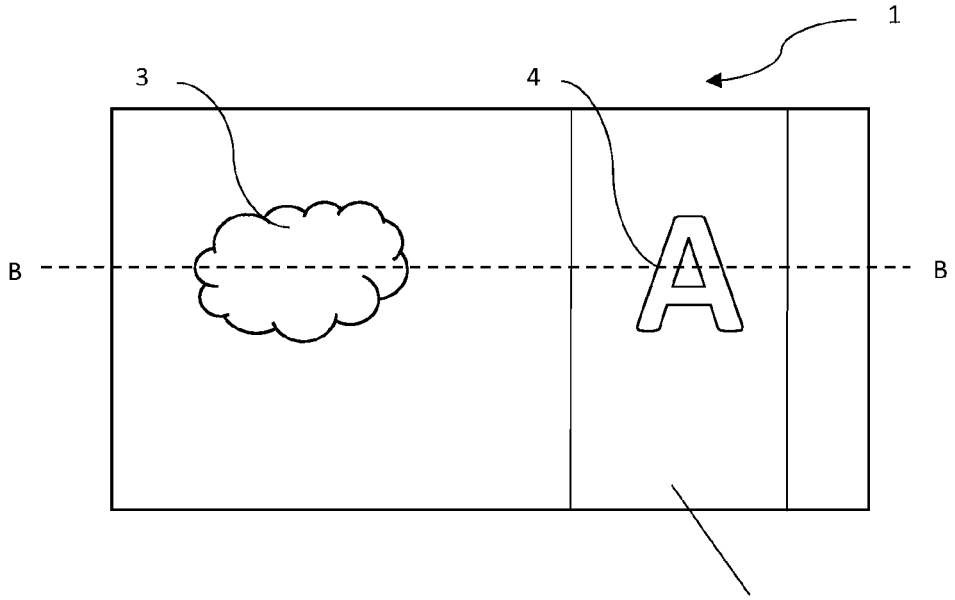
FIG. 1*b* shows a security document including two security features according to a first and a second embodiment of the invention in a plan view.
Figure 2B:
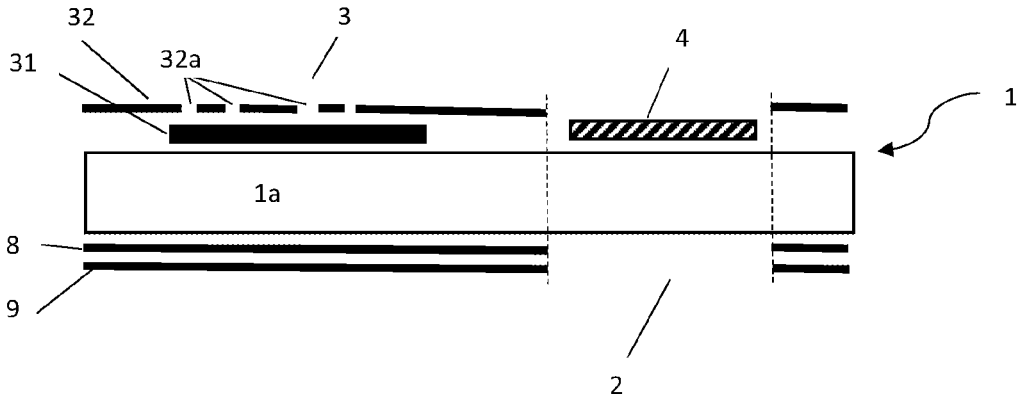
FIG. 2*b* shows a cross-section of FIG. 1*b* along line B-B.

FIG. 1*b* shows a second embodiment of the invention, and FIG. 2*b* shows a cross-section of second embodiment along line B-B.

In this embodiment, there is a multi-tonal image 4 being provided in the window region 2 of the security document 1. The multi-tonal image 4 is visible both in reflection and transmission, and is visible from either side of the security document 1.

The multi-tonal image 4 is formed in a single printed working, meaning all the tonal variation is introduced in a single printing step and at one printing station. In a preferred form, the multi-tonal image 4 is printed by a gravure printing unit including a gravure cylinder. The gravure cylinder includes an array of ink cells, arranged to receive a printing ink stored in an ink tank. As the gravure cylinder rotates in the ink tank, it contacts with the base substrate 1*a* and transfers the ink stored in the ink cells to the base substrate 1*a* in order to form an image. The ink cells of a gravure cylinder can be formed by directly engraving a metal surface of the gravure cylinder. After engraving, an optional protective surface material can be applied to enhance durability of the cylinder. The ink cells are formed to have a specific shape profile and location, which correspond to the image to be printed on the base substrate 1*a*. It will be appreciated that the ink cells can be modulated so that different ink cells have different shape profiles, (depth, diameter, density, and the like) and/or different locations on the gravure cylinder. In this manner, a multi-tonal image can be printed in one printing step, by having a set of specific shape profiles of ink cells on the cylinder representing a corresponding set of tonal ranges.

The second embodiment aims to provide a simple yet effective multi-tonal image, which is very easy to identify and authenticate by the public. Further, the tonal information is created in a single printing step, so it greatly reduces the material costs associated with manufacturing such features.

The multi-tonal image 4 is in a colour which visually contrasts with the rest of the security document, which is generally white or grey. However, it should be appreciated that other colours can also be chosen, depending on the requirement of such security features.

Third Embodiment

Figure 1C:
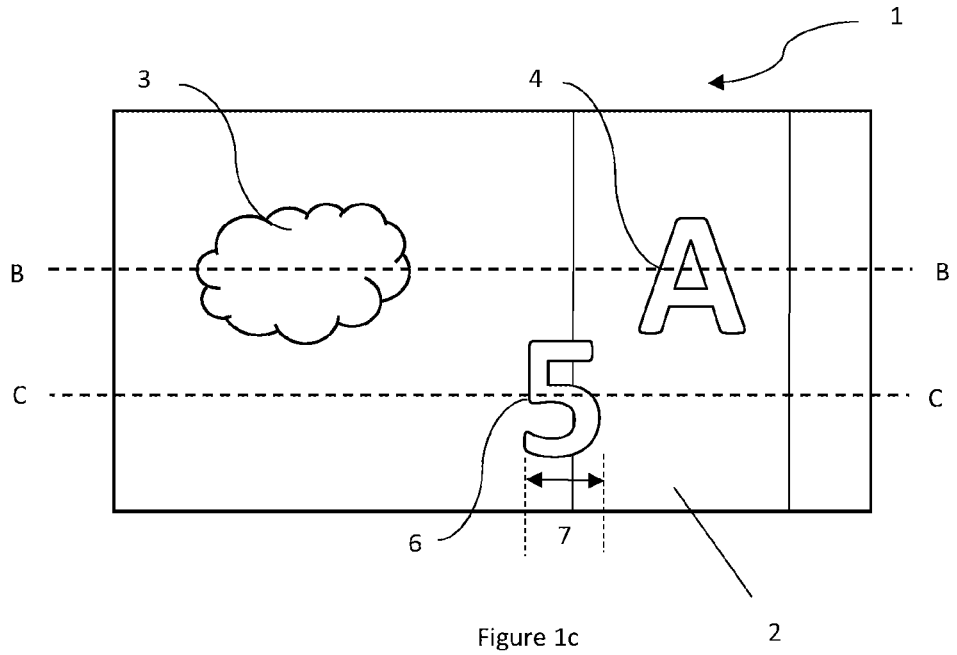
FIG. 1*c* shows a security document including three security features according to a first, second and third embodiment of the invention in a plan view.
Figure 2C:
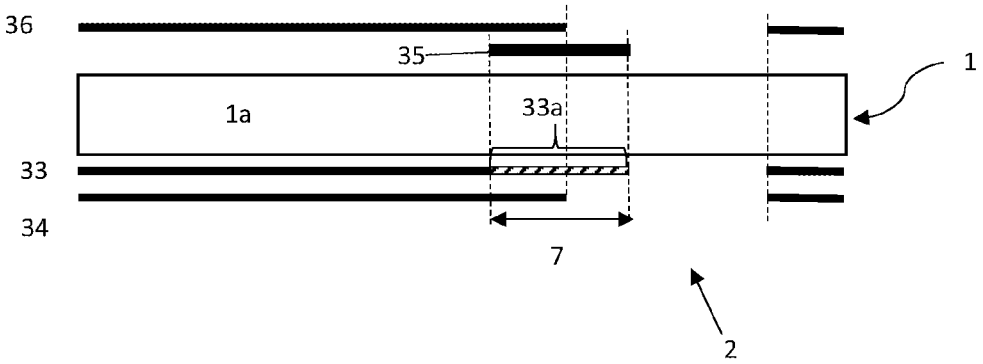
FIG. 2*c* shows a cross-section of FIG. 1*c* along line C-C.

FIGS. 1*c* and 2*c* illustrate a third embodiment of the invention in a plan view and in a cross-sectional view, FIG. 2*c* being a cross-section along line C-C.

Similar to the first embodiment, a multi-tonal image 6 is formed by two printed layers 33 and 35. In this embodiment, the corresponding image region 7 is partially located in a window region 2, and partially located in an opacified region, overlapping one or more opacifying layers 36. It should be appreciated that the multi-tonal image 6 displays a tonal effect when viewed from a bottom side of the security substrate 1, both in reflection and transmission, and regardless of whether it is located in the window region 2 or outside of the window region.

The first image layer 33 is an opacifying layer including a region 33*a* with tonal variation formed by methods described above. For example, this could be achieved by varying the sizes of ink cells of a gravure cylinder, so that different amount of ink is deposited in different regions to generate tonal variation. The second image layer 35 is a coloured layer applied in registration with the first image layer, and is free of tonal variation. The second image layer 35 is applied to cover a small area of the base substrate, so that the overall appearance of the security substrate 1 is still of a white or grey colour, allowing further security features to be formed thereon.

In another embodiment, both layers 33 and 35 may be formed such that a tonal variation subsists in each layer. That is, tonal variation is included in layer 35 as well. In this embodiment, a coloured multi-tonal image will be observable from both sides of the substrate. However, the image may appear differently depending on from which side the user is examining the security feature.

In the past, substrate level multi-tonal images are generally formed by overlapping a plurality of opacifying layers and by deliberately introducing openings of different sizes in the plurality of opacifying layers. While it is possible to produce a multi-tonal image in this manner, it requires multiple printed layers to achieve this effect, hence requiring multiple printing stations and multiple printing cylinders, as each printing cylinder could only print one layer of opacifying material, thereby increasing material cost and time required to produce such security features.

Another common issue with such images is that the image is generally more visible in transmission, and a lot less visible in reflection, which means sometimes it can be a bit difficult for the public to locate such images.

Another common issue with such images is that the plurality of opacifying layers must be registered to each other, as each layer contributes to a portion of the overall multi-tonal imagery effect. If one of the plurality of layers is outside of an allowable registration tolerance, the multi-tonal image will be distorted and the general public may not even recognise the existence of a security feature.

In contrast, the first and the third embodiments of the present disclosure require only two image layers to produce a coloured multi-tonal imagery effect, wherein each image layer is printed in a single printed working. The second embodiment above requires only a single printed working which simplifies the manufacturing process even further. In addition, the multi-tonal effect displayed by the embodiments of the present disclosure is equally visible in both reflection and transmission, thereby avoiding causing potential confusion for the general public.

OTHER EMBODIMENTS

FIGS. 2*d* to 2*g* illustrate other alternative embodiments of the present disclosure. In these embodiments, opacifying layers 3, 10, 11 and 12 are provided on each side of the base substrate 1*a* to create a dynamic multi-tonal effect. Specifically, the opacifying layers 3, 10-12 are applied to create a plurality of misregistered half windows 2*a*, 2*b*, 2*c*, 2*d*. The first imagery layer 31 is then sandwiched between these misregistered half windows. By 'misregistered half windows' it is meant that these windows, for example, misregistered half windows 2*a* and 2*b*, are displaced relative to each other such that there is no overlap between their corresponding window regions, but one of their edges is aligned, as indicted by line D-D in respect of FIG. 2*d*. PCT application WO2016149762A1 discloses details of how such misregistered half windows are formed, and the contents of this application is incorporated herein by reference.

Figure 2D:
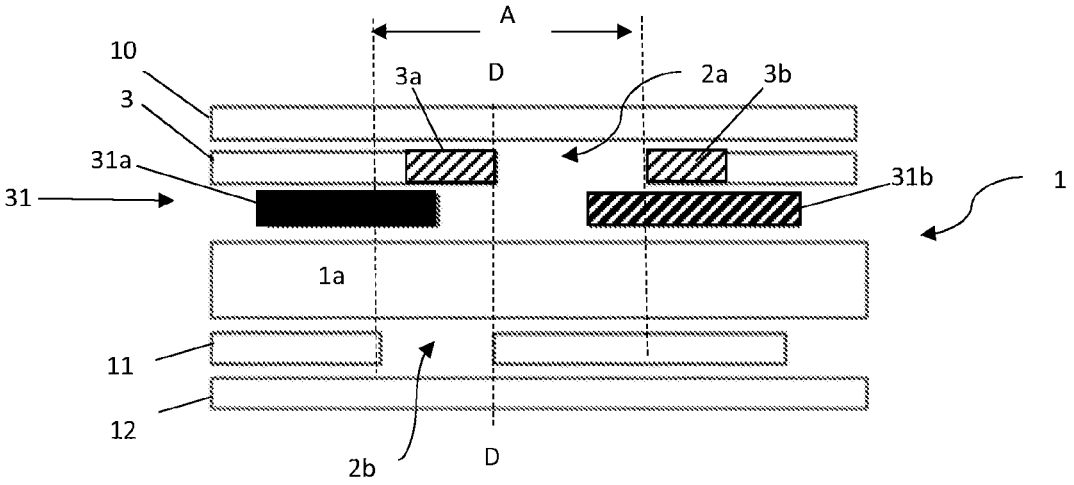
FIGS. 2*d*-2*g* illustrate other alternative embodiments of the present disclosure.

With reference to FIG. 2*d*, two misregistered half windows 2*a* and 2*b* are provided on each side of the base substrate 1*a*. In this embodiment, different coloured multi-tonal effects will be observed from each side of the security document 1, thus making it more difficult to counterfeit, and easier to recognize by the general public. It will also be appreciated that the two misregistered half windows 2*a* and 2*b* by themselves do not create a multi-tonal effect. They are included to merely create a region A of reduced opacity comparing to the rest of the substrate, and the region A has different impact on the perceived colour of the coloured image layer 31 depending on which side a viewer is observing the image. Region A includes three layers of opacifying layers, whereas outside of Region A four layers of opacifying layers are provided to the substrate 1*a*.

Coloured image layer 31 has two regions in this example, a region 31*a* with no tonal variation (mono-tonal) and a region 31*b* with tonal variation. Optionally, as shown in the embodiment of FIG. 2*d*, opacifying layer 3 may have sub-regions with tonal variation, such as sub-regions 3*a*, 3*b*. Tonal variation in these layers can be generated by the methods disclosed in other embodiments, such as by variance in the amount of ink laid down in the layer according to a pre-defined tone. In embodiments which relies on the tonal variation in the image layer 31 alone, the opacifying layer 3 is mono-tonal in sub-regions 3*a* and 3*b*.

The multi-tonal image generated by this embodiment will be visible in both transmission and reflection from each side. However, its appearances may change depending on which side it is viewed from.

Figure 2E:
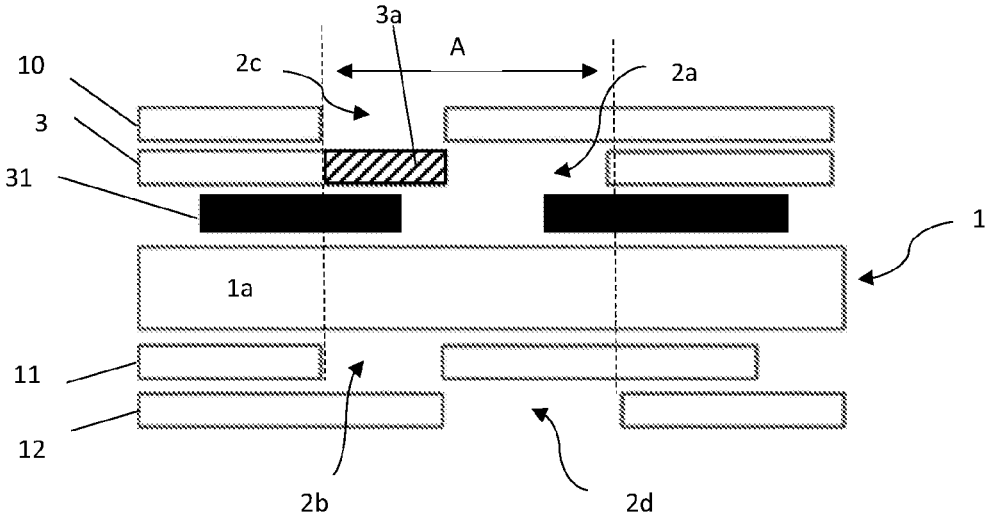

Turning to FIG. 2*e*, four misregistered half windows 2*a*-2*d* are provided to the security document 1. In this embodiment, Region A is again created to form a region of reduced opacify comparing to the rest of the substrate, with only two layers of opacifying material within this region.

Layer 31, in this embodiment is a mono-tonal coloured image layer. As with FIG. 2*d*, opacifying layer 3 may have sub-regions, such as sub-region 3*a*, with tonal variation. Once again, tonal variation in the sub-regions of layer 3 can be generated by the methods disclosed in other embodiments. In embodiments which relies on the tonal variation in the image layer 31 alone, the opacifying layer 3 is mono-tonal in sub-region 3*a*.

Figure 2F:
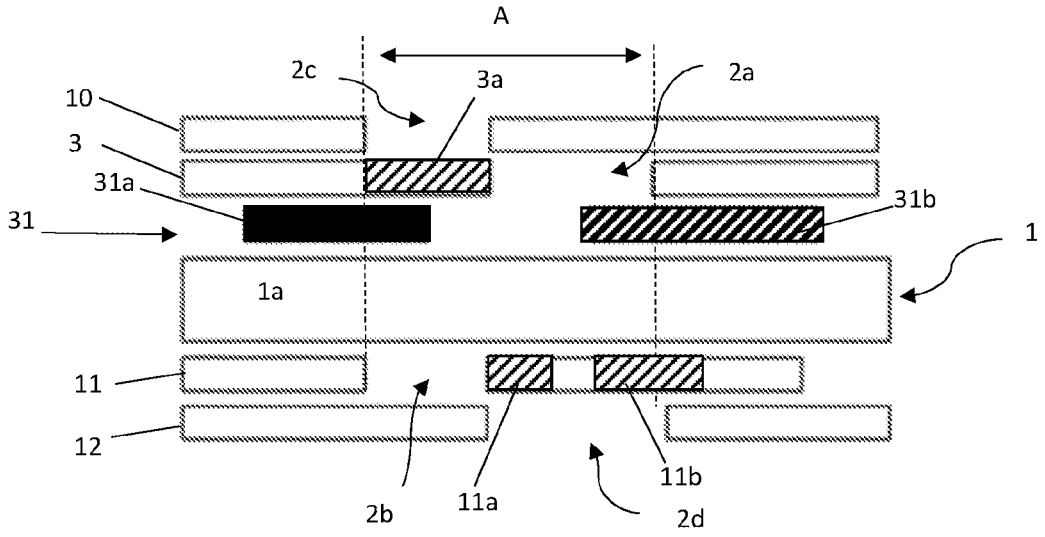

FIG. 2*f* shows another embodiment, which is similar to the embodiment of FIG. 2*e*, however, tonal variation is introduced into the coloured image layer 31 using methods described herein. Coloured image layer 31 has two regions, in this example, a region 31*a* with no tonal variation (mono-tonal) and a region 31*b* with tonal variation. Optionally, opacifying layers 3 and 11 may have sub-regions, such as sub-region 3*a*, 11*a* and 11*b*, with tonal variation. Once again, tonal variation in the sub-regions of layer 3 and 11 can be generated by the methods disclosed in other embodiments. In embodiments which relies on the tonal variation in the image layer 31 alone, the opacifying layers 3 and 11 are mono-tonal in sub-regions 3*a*, 11*a* and 11*b*.

Figure 2G:
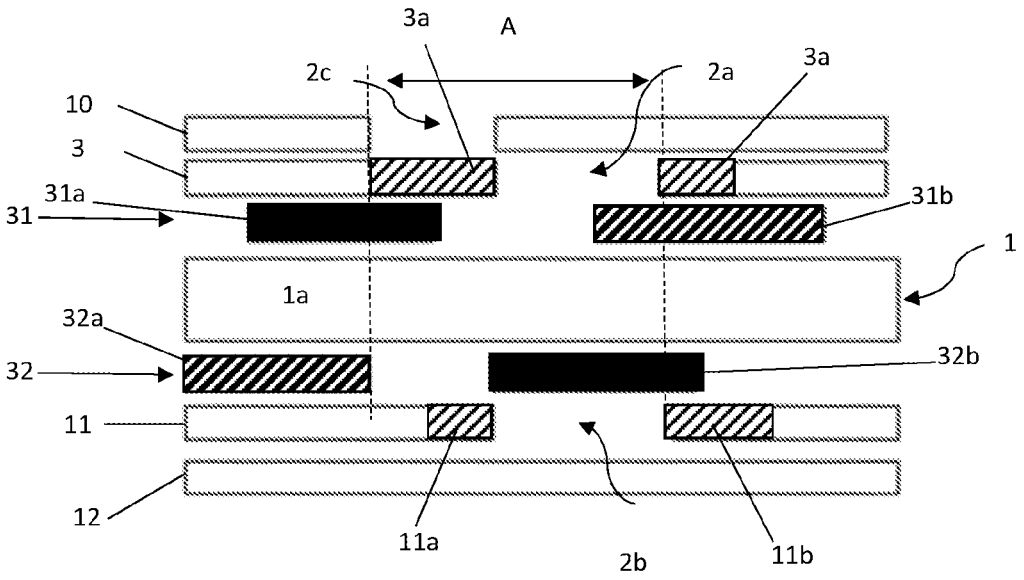

FIG. 2*g* shows another embodiment, similar to the embodiment of FIG. 2*f*, in which a second coloured imagery layer 32 is included to create more complex multi-tonal image. Coloured image layer 31 and 32 each have two regions, in this example, a region 31*a*, 32*b* with no tonal variation (mono-tonal) and a region 31*b*, 32*a* with tonal variation. Optionally, opacifying layers 3 and 11 may have sub-regions, such as sub-region 3*a*, 3*b*, 11*a* and 11*b*, with tonal variation. Once again, tonal variation in the sub-regions of layer 3 and 11 and regions of the coloured image layers 31 and 32 can be generated by the methods disclosed in other embodiments. In embodiments which relies on the tonal variation in the image layers 31 and 32 alone, the opacifying layers 3 and 11 are mono-tonal in sub-regions 3*a*, 3*b*, 11*a* and 11*b*

It will be understood that the invention is not limited to the specific embodiments described herein, which are provided by way of example only. The scope of the invention is as defined by the claims appended hereto.

What is claimed is:

1. A security feature comprising:

a substrate including a first surface and a second surface, a first image layer applied to the first surface of the substrate, by depositing a coloured ink in selected regions of the substrate to form a first image, a second image layer applied to the substrate, wherein the second image layer is a layer of semi-opaque material including transparent or translucent regions in which the semi-opaque material is omitted or reduced, at least some of the transparent or translucent regions overlap with the first image, wherein the first and the second image layer collectively define a coloured multi-tonal image that is visible both in transmission and reflection when the security feature is viewed from a first side of the substrate, and wherein when the security feature is viewed from a second side of the substrate a mono-tonal version of the first image layer is visible, both in reflection and transmission.

2. The security feature of claim 1, wherein coloured ink is deposited on less than 50% surface area of the substrate, or less than 30%, or less than 20%.

3. The security feature of claim 1, wherein the first and the second image layers are provided on opposing first and second surfaces of the substrate, or on the same surface of the substrate.

4. The security feature of claim 1, wherein the transparent or translucent regions of the second image layer are arranged to form one or more tonal values of the multi-tonal image.

5. The security feature of claim 4, wherein the transparent or translucent regions of the second image layer correspond to darker tone(s) of the multi-tonal image compared to non-transparent or non-translucent regions of the second image layer.

6. The security feature of claim 4, wherein the first image layer defines a mono-tonal version of the multi-tonal image, and the second image layer provides tonal variations for the mono-tonal image.

7. The security feature of claim 1, wherein the first and the second image layers are both printed using a gravure printing unit in an in-line printing process.

8. The security feature of claim 7, wherein the printing surface of the gravure printing unit includes an array of ink cells configured to receive ink during an image printing process, wherein the ink cells are modulated to form tonal variation that is required to produce a multi-tonal effect.

9. The security feature of claim 1, wherein one or more additional layers of opacifying material are applied to the first and/or the second surface of the substrate.

10. The security feature of claim 1, wherein the multi-tonal image appears substantially similar in reflection and transmission when viewed from the first side of the substrate.

11. The security feature of claim 1, wherein the second printed image layer is formed in a substantially white or grey colour, and the first printed image layer is formed in a different colour which visually contrasts with white or grey.

12. The security feature of claim 1, wherein the security feature is formed in a window or a half-window region of a security substrate, wherein said security substrate can be printed upon and further processed into a security document.

13. The security feature of claim 1, wherein the substrate is substantially transparent and is made from a polymeric material.

14. A security feature comprising:

a substrate including a first surface and a second surface, a first image layer applied to the first surface of the substrate, by depositing a coloured ink in selected regions of the substrate to form a first image, a second image layer applied to the substrate, wherein the second image layer is a layer of semi-opaque material including transparent or translucent regions in which the semi-opaque material is omitted or reduced, at least some of the transparent or translucent regions overlap with the first image, wherein the first and the second image layer collectively define a coloured multi-tonal image that is visible both in transmission and reflection, wherein one or more additional layers of opacifying material are applied to the first and/or the second surface of the substrate, and wherein the one or more additional layers of opacifying material are applied such that the first image layer is sandwiched between two misregistered half-windows, the two misregistered half-windows creating a region of reduced opacity in the substrate.

15. The security feature of claim 14, wherein the one or more additional layers of opacifying material are applied such that the first image layer is sandwiched between four misregistered half-windows, two on each side of the substrate, the four misregistered half-windows creating a region of reduced opacity in the substrate.

16. The security feature of claim 14, wherein a different coloured multi-tonal effect is observed from each side of the substrate.

17. A security feature comprising:

a substrate including a first surface and a second surface, a first printed working and a second printed working applied to the substrate, wherein the first printed working and the second printed working at least partially overlap and are registered to one another, the first printed working is multi-tonal, the first printed working and the second printed working are each formed in a single printed layer and in contrasting colours, the first printed working and the second printed working collectively provide a coloured multi-tonal image visible both in reflection and transmission, wherein the first printed working and the second printed working are both printed in an in-line printing process, and wherein a printing surface of a printing unit in the in-line printing process includes an array of ink cells configured to receive ink during an image printing process, wherein the ink cells are modulated to form tonal variation to produce the multi-tonal first printed working.

18. The security feature of claim 17, wherein the second printed working is free of tonal variation.

19. The security feature of claim 17, wherein the second printed working is multi-tonal.

20. The security feature of claim 17, wherein the first printed working and the second printed working are both printed using a gravure printing unit in the in-line printing process, and wherein the printing unit is a gravure printing unit.

* * * * *